US005732899A

United States Patent [19]

Wells

[11] Patent Number: 5,732,899

[45] Date of Patent: Mar. 31, 1998

[54] WIRE REEL UNWIND ASSEMBLY INCLUDING WIRE REEL MOUNTING UNIT

[76] Inventor: William Edgar Wells, 3400 S. Preble County Line Rd., West Alexandria, Ohio 45381

[21] Appl. No.: 641,162

[22] Filed: Apr. 29, 1996

[51] Int. Cl.[6] ..... B65H 59/02

[52] U.S. Cl. ..... 242/423.1; 242/598.3; 242/598.5; 242/615.2

[58] Field of Search ..... 242/423.1, 560, 242/566, 591, 598.3, 598.5, 599.4, 588, 557, 615.2, 615.3, 397.5, 559.1, 559.2; 211/163

[56] References Cited

U.S. PATENT DOCUMENTS

| | | | |
|---|---|---|---|
| 464,623 | 12/1891 | Lewy | 242/559.2 X |
| 834,790 | 10/1906 | Wolford | 242/559.2 X |
| 946,116 | 1/1910 | Engel . | |
| 1,299,677 | 4/1919 | Carroll | 242/559.2 X |
| 1,813,831 | 7/1931 | Wessler | 242/615.2 X |
| 1,818,518 | 8/1931 | Young . | |
| 2,893,657 | 7/1959 | Van de Bilt . | |
| 3,204,887 | 9/1965 | Hansen et al. | 242/559.2 |
| 3,603,526 | 9/1971 | Payne et al. . | |
| 3,738,588 | 6/1973 | Ayers | 242/423.1 |
| 3,788,573 | 1/1974 | Thomson et al. | 242/423.1 |
| 4,143,826 | 3/1979 | Lamperti | 242/615.3 X |
| 4,190,211 | 2/1980 | Janzen | 242/423.1 |
| 4,208,021 | 6/1980 | Wall | 242/557 X |
| 4,412,662 | 11/1983 | Rutecki . | |
| 4,483,491 | 11/1984 | Rainey | 242/598.3 |
| 4,508,290 | 4/1985 | Bauer . | |
| 4,564,152 | 1/1986 | Herriage . | |
| 4,611,645 | 9/1986 | Whisnant . | |
| 4,728,049 | 3/1988 | Veith et al. | 242/557 X |
| 5,007,597 | 4/1991 | Jones . | |
| 5,090,647 | 2/1992 | Clarke | 242/615.2 X |
| 5,188,308 | 2/1993 | Tussing . | |
| 5,275,349 | 1/1994 | Tussing . | |
| 5,285,981 | 2/1994 | Pavelka | 242/557 |
| 5,315,853 | 5/1994 | Scheiterle | 242/598.3 X |
| 5,322,236 | 6/1994 | Smith . | |
| 5,374,007 | 12/1994 | Murison | 242/598.3 X |
| 5,465,917 | 11/1995 | Kosch . | |
| 5,573,226 | 11/1996 | Smith | 242/615.3 X |

FOREIGN PATENT DOCUMENTS

| | | | |
|---|---|---|---|
| 4240644 | 6/1994 | Germany | 242/423.1 |

*Primary Examiner*—Daniel P. Stodala
*Assistant Examiner*—William A. Rivera
*Attorney, Agent, or Firm*—Killworth, Gottman, Hagan & Schaeff, L.L.P.

[57] ABSTRACT

A selectively rotatable wire reel unwind assembly is provided including a plurality of conveniently and compactly arranged reel mounting positions, a readily controllable, rotation resistive, wire reel unwind unit, and a sliding, position selective, wire guide unit. The reel unwind assembly comprises: a rigid unwind assembly frame; a rotatable unwind assembly post mounted to the unwind assembly frame and rotatable about a postal axis of rotation; at least one reel mounting unit fixed to the assembly post and including a plurality of reel mounting positions, the reel mounting positions defining a plurality of reel axes, the plurality of reel axes lying substantially in a reel axis plane, and the reel axis plane being oriented perpendicular to the postal axis of rotation; a reel axle positioned in a corresponding one of the reel mounting positions; a rotatable reel unit coupled to the reel axle so as to be rotatable about the reel axle; a rotation resistive surface and a reel unit mounting mechanism arranged to vary a degree of resistive contact between the rotatable reel unit and the rotation resistive surface; a wire guide track incorporated in the rigid unwind assembly frame; and, a wire guide unit slidably mounted to the wire guide track to permit movement of the wire guide unit in a direction parallel to the postal axis of rotation.

24 Claims, 4 Drawing Sheets

WIRE REEL UNWIND ASSEMBLY INCLUDING WIRE REEL MOUNTING UNIT

BACKGROUND OF THE INVENTION

The present invention relates to a wire reel unwind and, more particularly, to a selectively rotatable reel unwind assembly including a plurality of reel mounting positions, a rotation resistive reel unwind unit, and a sliding, position selective, wire guide unit.

Electrical wire is commonly provided in the form of a length of wire wound around a spool. A user selects a specific length of wire for use by unwinding the spool and cutting the specific length of wire. A spool may be mounted so as to spin about an axle to provide for easier unwinding and cutting. A spinning spool of wire is often problematic, however, because of the difficulty in controlling the rate of wire unwind and the stoppage of wire unwind. Excessive wire unwind can lead to wire tangling, unsafe working conditions, and lost productivity.

A user is often required to work with a plurality of different spools of wire because a plurality of different wires are often necessary for a particular task. The prospect of working with many different spools of wire is also problematic because of confined work spaces. Additionally, it is often difficult to arrange the spools of wire in an organized and efficient manner within a work space.

Accordingly, there is a need for a wire reel unwind that provides for safe, efficient, and convenient storage of a maximum number of wire spools. Further, there is a need for a wire reel unwind that provides for convenient and efficient selection and use of a single spool of wire from a plurality of stored wire spools. Finally, there is a need for a wire reel unwind that provides for controllable wire unwind, eliminates the possibility of excessive wire unwind, and reduces damage to the wire during unwind.

The conventional wire reel stands, wire guides, and wire brakes have not met these needs. For example, U.S. Pat. No. 4,611,645 discloses a creel-type wire reel stand incorporating fixed wire reel spindles and fixed wire guides. The creel-type stand is not, however, designed to incorporate provisions for eliminating excessive wire reel unwind or reducing wire damage during unwind. Additionally, the number of reels which may be stored on the creel-type stand is limited to a specified number of stationary pairs running along the height dimension of the stand. Similarly, U.S. Pat. No. 4,564,152 discloses a wire reel storage device including pairs of stationary spindles mounted along the height of the device. Further, although the storage device disclosed in U.S. Pat. No. 4,565,152 includes a wire guide, the wire guide does not minimize wire wear in that it can not be aligned with a single spool. Rather, the wire guide can only be positioned between a selected pair of spools. U.S. Pat. Nos. 2,893,657 and 5,465,917 disclose wire reel unwind arrangements including unwind brakes, however, neither of these devices are designed to be conveniently incorporated in a wire reel unwind assembly including a plurality of conveniently and compactly arranged reel mounting positions.

SUMMARY OF THE INVENTION

The needs noted above are met by the present invention wherein a selectively rotatable wire reel unwind assembly is provided including a plurality of conveniently and compactly arranged reel mounting positions, a readily controllable, rotation resistive, wire reel unwind unit, and a sliding, position selective, wire guide unit.

In accordance with one embodiment of the present invention, a reel unwind assembly is provided comprising: a rigid unwind assembly frame; a rotatable unwind assembly post mounted to the unwind assembly frame and rotatable about a postal axis of rotation; at least one reel mounting unit fixed to the assembly post and including a plurality of reel mounting positions, the reel mounting positions defining a plurality of reel axes, the plurality of reel axes lying substantially in a reel axis plane, and the reel axis plane being oriented perpendicular to the postal axis of rotation; a reel axle positioned in a corresponding one of the reel mounting positions; a rotatable reel unit coupled to the reel axle so as to be rotatable about the reel axle; a rotation resistive surface and a reel unit mounting mechanism arranged to vary a degree of resistive contact between the rotatable reel unit and the rotation resistive surface; a wire guide track incorporated in the rigid unwind assembly frame; and, a wire guide unit slidably mounted to the wire guide track to permit movement of the wire guide unit in a direction parallel to the postal axis of rotation.

In accordance with another embodiment of the present invention, a reel unwind assembly is provided comprising a rigid unwind assembly frame; a rotatable unwind assembly post mounted to the unwind assembly frame and rotatable about a postal axis of rotation; and at least one reel mounting unit fixed to the assembly post and including a plurality of reel mounting positions, the reel mounting positions defining a plurality of reel axes, the plurality of reel axes lying substantially in a reel axis plane and the reel axis plane being oriented perpendicular to the postal axis of rotation.

The rigid unwind assembly frame may comprise a frame base and a frame extension, and the rotatable unwind assembly post may extend between the frame base and the frame extension along the postal axis of rotation. The rigid unwind assembly frame may comprises a wire guide track extending in a direction parallel to the postal axis of rotation, and a wire guide unit slidably mounted to the wire guide track. The wire guide unit may comprise a wire input face and a wire output face a first multidirectional rolling wire escort including a wire entry aperture positioned at the wire input face, and a second multidirectional rolling wire escort including a wire exit aperture positioned at the wire output face. The first and second rolling wire escort may comprise first, second, third, and fourth rollers including corresponding first, second, third, and fourth v-shaped guide grooves, wherein the rollers are substantially radially aligned with and equidistant from a center of the wire entry or exit aperture, and wherein the rollers are positioned at 90° intervals with respect to the entry aperture center.

The rotatable unwind assembly post may comprise post rotation locking positions, and the rigid unwind assembly frame may include a rotation locking unit arranged to selectively engage the post rotation locking positions. The post rotation locking positions may comprise holes, and the rotation locking unit may include a hole engaging member coupled to a locking cable and a locking cable lever.

The reel mounting unit may comprise a plurality of reel mounting units fixed to the assembly post at spaced positions along a path parallel to the postal axis of rotation and the rigid unwind assembly frame may comprise a wire guide track, and a wire guide unit slidably mounted to the wire guide track to permit movement of the wire guide unit to a selected wire guide position corresponding to a position of one of the plurality of reel mounting units.

The reel mounting unit may comprise four L-shaped extensions and each of the L-shaped extensions may include a first reel axle mounting point. The plurality of reel axes may be defined by linear projections from each of the first reel axle mounting points to a second reel axle mounting point included in another L-shaped extension. Alternatively, the at least one reel mounting unit further comprises four auxiliary extensions, and the plurality of reel axes are defined by linear projections from each of the first reel axle mounting points to a corresponding second reel axle mounting point provided in each of the four auxiliary extensions. Each of the plurality of reel axes may lie in one of a reel unwind position and a rotated reel unwind position. The reel unwind position and the rotated reel unwind position are preferably co-planar.

At least one of the reel mounting positions may comprise a reel axle, a rotatable reel unit coupled to the reel axle so as to be rotatable about the reel axle, a rotation resistive surface, and a reel unit mounting mechanism arranged to vary a degree of resistive contact between the rotatable reel unit and the rotation resistive surface. The reel axle preferably includes a first axle end including a resistive surface receiving plate and an opposite axle end including a threaded surface. The rotatable reel unit may comprises a cylindrical sleeve and a resistive surface engaging plate. The rotation resistive surface may comprise a first surface and a second roughened surface. The reel unit mounting mechanism may comprise a first reel engaging member positioned at a first reel end of the rotatable reel unit, a second reel engaging member positioned at an opposite reel end of the rotatable reel unit, and a reel unit pressing member positioned at the opposite reel end. The first reel engaging member may comprise a reel engaging pin, the second reel engaging member may comprise a spool retaining collar, and the reel unit pressing member may comprise a threaded nut.

Accordingly, it is an object of the present invention to provide a wire reel unwind including a selectively rotatable rigid unwind assembly including a plurality of reel mounting positions, a rotatable reel unit in a reel mounting position including a rotation resistive surface, a reel unit mounting mechanism arranged to vary a degree of resistive contact between the rotatable reel unit and the rotation resistive surface, and a wire guide unit slidably mounted to a wire guide track to permit selectable movement of the wire guide unit.

DETAILED DESCRIPTION OF THE INVENTION

Figure 1:
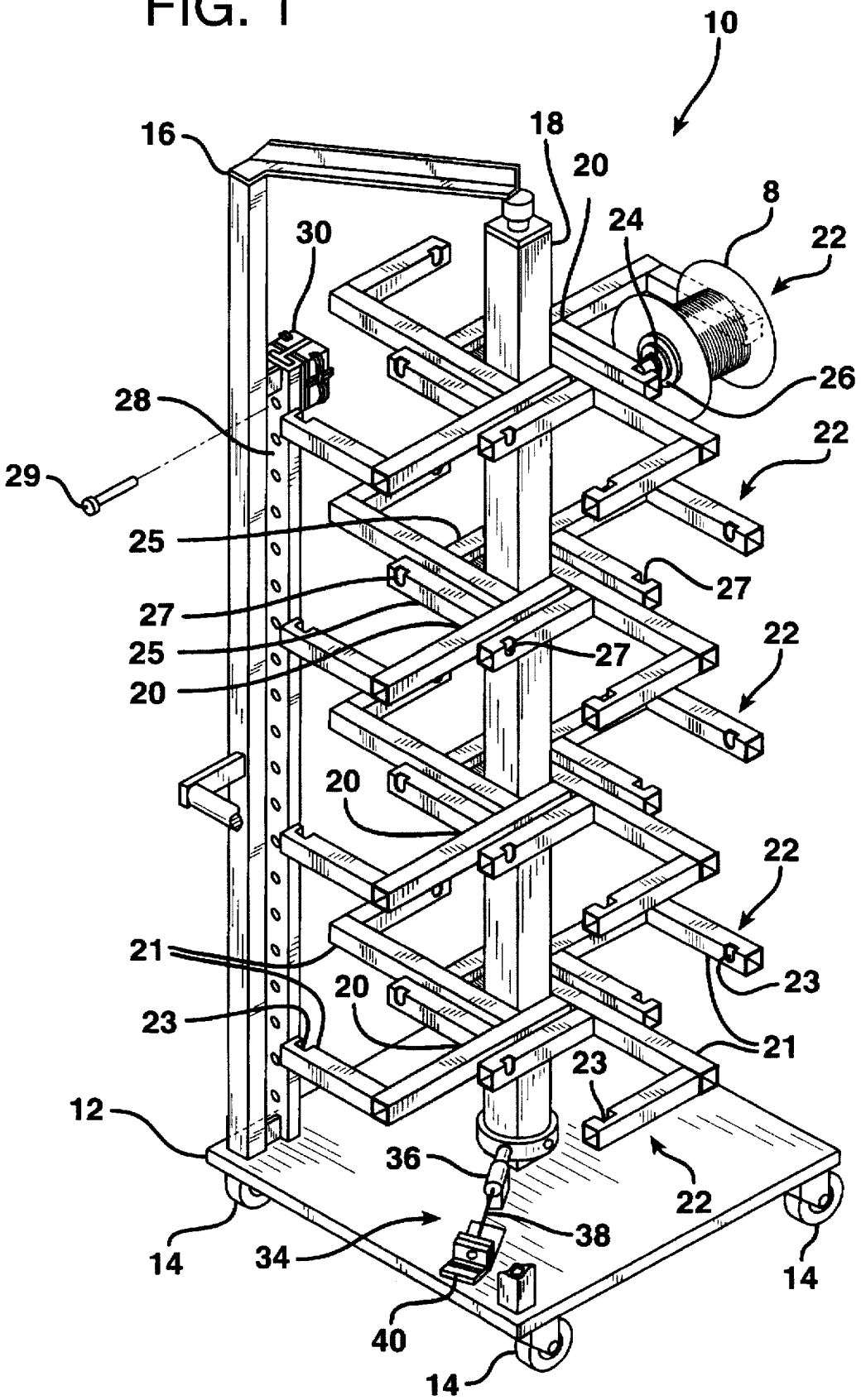
FIG. 1 is a perspective view of a wire reel unwind according to a first embodiment the present invention.
Figure 3:
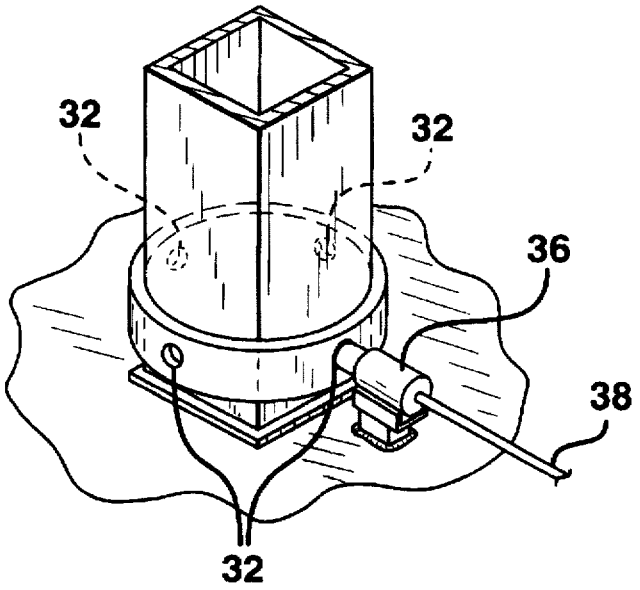
FIG. 3 is a perspective view of a post rotation locking assembly according to the present invention.
Figure 5:
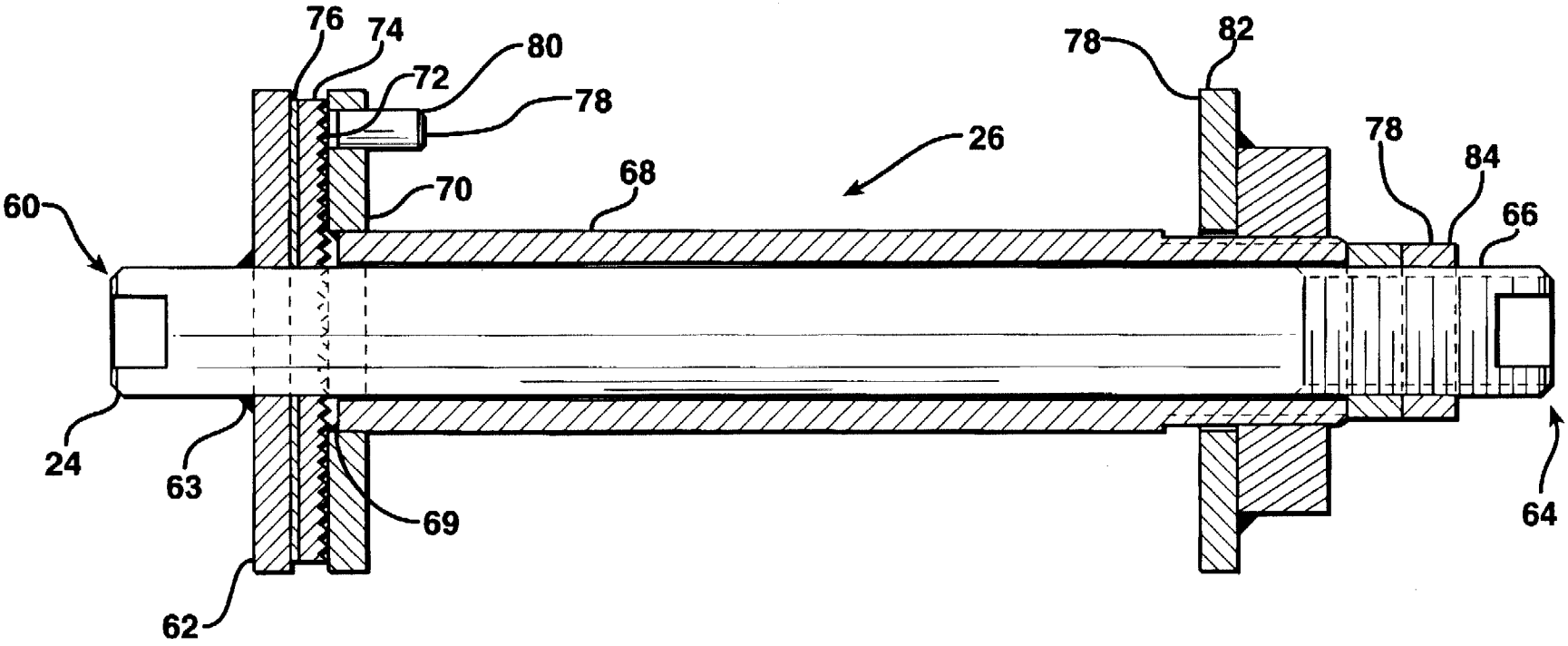
FIG. 5 is a cross sectional view of a rotatable reel unit and a corresponding reel axle according to the present invention.

A selectively rotatable wire reel unwind assembly 10 according to the present invention is illustrated in FIG. 1. The wire reel unwind assembly 10 includes a rigid unwind assembly frame comprising a frame base 12 mounted on casters 14 and a frame extension 16 extending from the frame base 12. A rotatable unwind assembly post 18 extends between the frame base 12 and the frame extension 16 along a postal axis of rotation corresponding to the central axis of the assembly post 18. A series of reel mounting units 20 are fixed at spaced positions to the assembly post 18. Each reel mounting unit 20 includes a plurality of reel mounting positions 22 defining a plurality of reel axes lying substantially in a reel axis plane oriented perpendicular to the postal axis of rotation. A reel axle 24, described in detail below with reference to FIG. 5, is positioned in a corresponding one of the reel mounting positions 22. A rotatable reel unit 26, also described in detail below with reference to FIG. 5, is coupled to the reel axle 24 so as to be rotatable about the reel axle 24. A wire guide track 28 is incorporated in the rigid unwind assembly frame. A wire guide unit 30 is slidably mounted to the wire guide track 28 to permit movement of the wire guide unit 30 in a direction parallel to the postal axis of rotation. It is contemplated by the present invention that a variety of devices may be utilized to fix the position of the wire guide unit at a selected wire guide position corresponding to a position of one of said plurality of reel mounting units 20. In FIG. 1, a locking pin 29 is illustrated as an example of a device designed to fix the position of the wire guide unit 28. The rotatable unwind assembly post 18 includes post rotation locking holes 32. A spring loaded rotation locking unit 34, shown in detail in FIG. 3, is mounted to the frame base 12 and is arranged to selectively engage the post rotation locking holes 32. The rotation locking unit includes a hole engaging member, or piston 36, coupled to a locking cable 38 and a locking cable lever 40.

Figure 2:
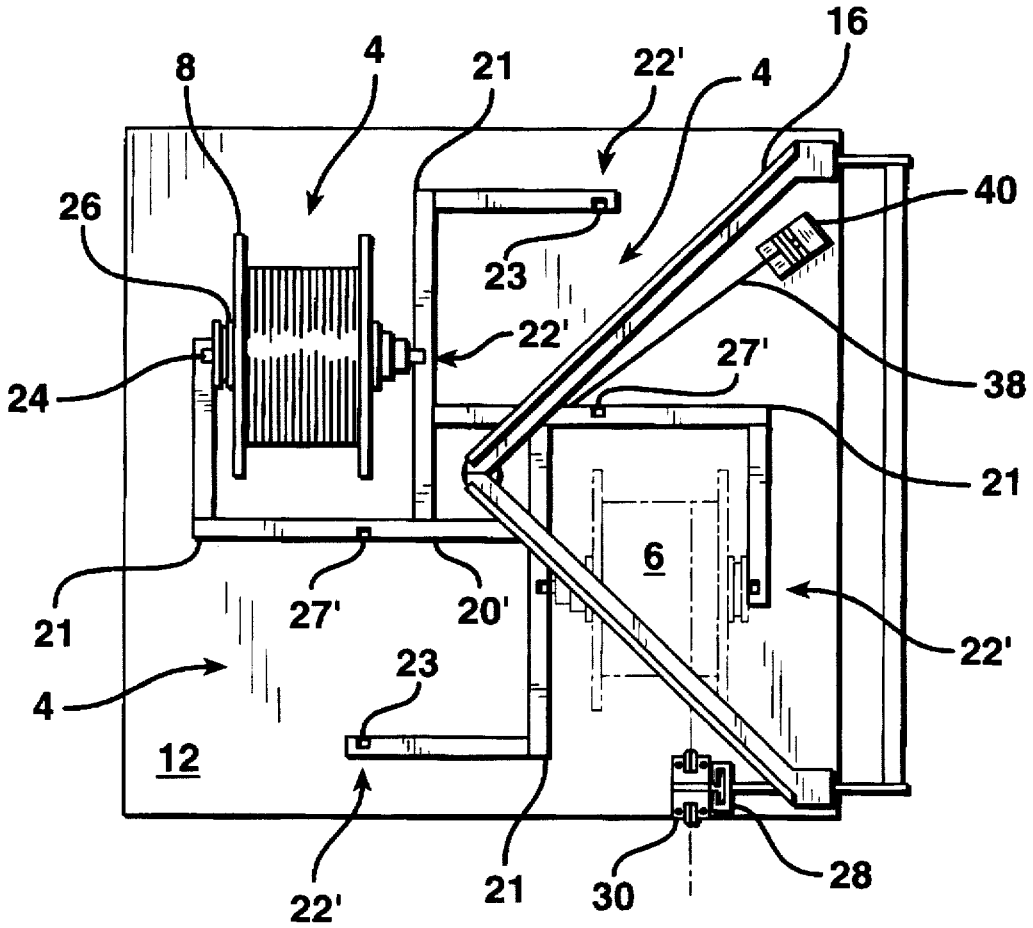
FIG. 2 is a top view of a wire reel unwind according to another embodiment of the present invention.

Each reel mounting unit 20 comprises four L-shaped extensions 21. Each of the L-shaped extensions 21 includes a first reel axle mounting point 23. Each reel mounting unit 20 further comprises four auxiliary extensions 25 including a corresponding second reel axle mounting point 27. As is illustrated in FIG. 1, the reel axle 24 and the first and second reel axle mounting points 23, 27 define a drop-in engagement, i.e., the reel axle 24 is positioned in the first and second reel axle mounting points 23, 27 by lowering the reel axle 24 into the mounting points 23, 27. The plurality of reel axes are defined by linear projections from each of the first reel axle mounting points to the corresponding second reel axle mounting point 27. As illustrated in FIG. 2, each of the plurality of reel axes either lies in a reel unwind position 6 or one of three rotated reel unwind positions 4. The reel unwind position 6 and the rotated reel unwind positions 4 are co-planar. It is contemplated by the present invention that, although four reel mounting units are illustrated in FIG. 1, any number of reel mounting units may be provided along the rotatable unwind assembly post 18, e.g., one, two, three, or more reel mounting units 20.

FIG. 2 also illustrates an alternative reel mounting unit design. Like the reel mounting unit 20 illustrated in FIG. 1, each reel mounting unit 20' in FIG. 2 comprises four L-shaped extensions 21 and each of the L-shaped extensions 21 includes a first reel axle mounting point 23. However, in the FIG. 2 embodiment each L-shaped extension 21 further includes a second reel axle mounting point 27' such that the plurality of reel axes are defined by linear projections from each of the first reel axle mounting points 23 to the second reel axle mounting point 27' included in another L-shaped extension 21.

A spool of wire 8 may be positioned in each of the reel mounting positions 22 of the wire reel unwind assembly 10 to permit convenient selection and use of a single spool of wire 8 from a plurality of wire spools stored in the wire reel unwind assembly 10. When the rotation locking unit 34 is disengaged by depressing the locking cable lever 40, the assembly post is rotatable about the postal axis of rotation and a selected spool of wire 8 may be positioned in a wire reel unwind position 6. Additionally, the wire guide unit 30, which is slidably mounted to the wire guide track 28, may be moved to the reel axis plane corresponding to the selected spool. In this manner, the wire from a spool in the wire reel unwind position 6 can be fed through the wire guide unit 30 and subsequently unwound from its spool by applying an appropriate pulling force to the wire. Subsequent spools may be selected by merely removing the wire from the wire guide unit 30, depressing the locking cable lever 40, rotating the assembly post 18 to the selected position, sliding the wire guide unit 30 to the appropriate position, and refeeding the newly selected wire through the wire guide unit 30. It is contemplated by the present invention that a plurality of wire guide units 30, as opposed to a single movable wire guide unit 30, may be fixedly mounted to the frame extension 16 at positions corresponding to each wire reel unwind position 6.

Figure 4B:
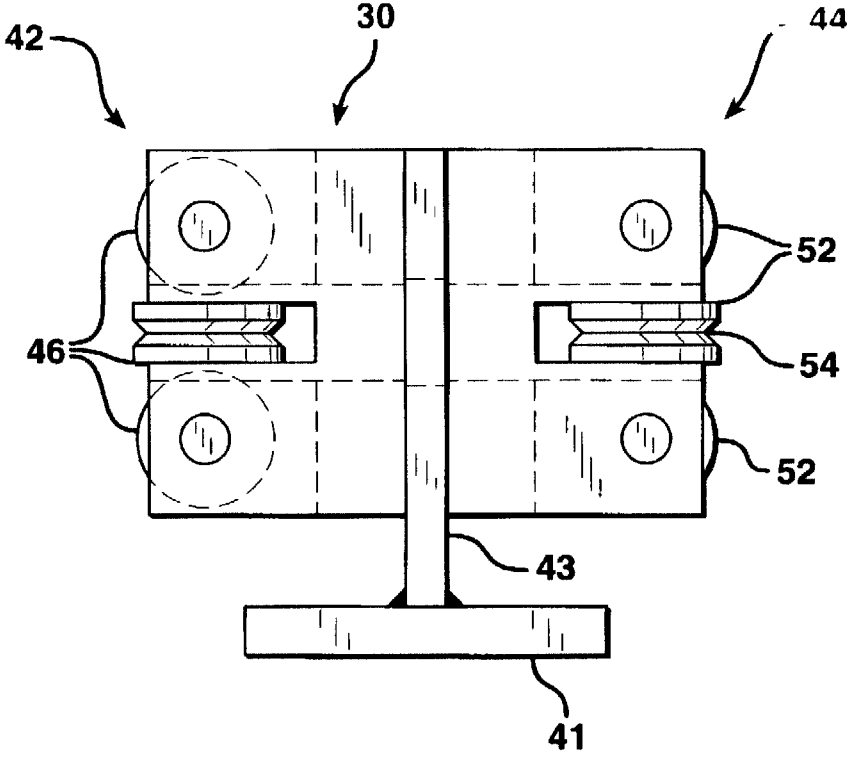
FIGS. 4A and 4B are front and side views of a wire guide unit according to the present invention.
Figure 4A:
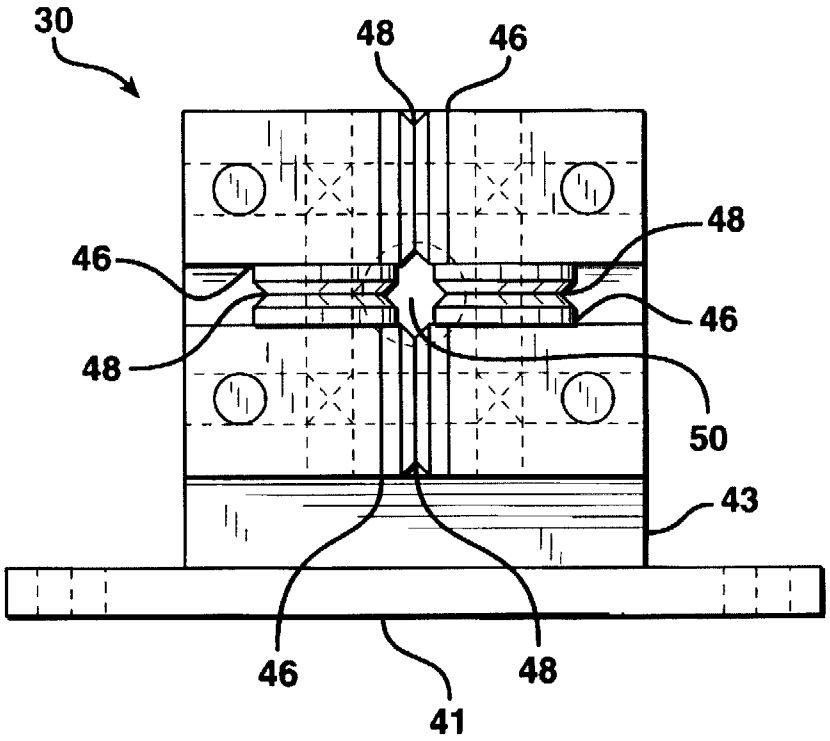

The wire guide unit 30 is shown in detail in FIGS. 4A and 4B. The wire guide unit 30 comprises a sliding base portion 41, a stem portion 43, a wire input face 42 and a wire output face 44. First, second, third, and fourth entry rollers 46 including corresponding first, second, third, and fourth v-shaped entry guide grooves 48 define a first multidirectional rolling wire escort including a wire entry aperture 50 positioned at the wire input face 42. First, second, third, and fourth exit rollers 52 including corresponding first, second, third, and fourth v-shaped exit guide grooves 54 define a second multidirectional rolling wire escort including a wire exit aperture positioned at said wire output face 44. The entry rollers 46 are substantially radially aligned with, and equidistant from, a center of said wire entry aperture 50, and are positioned at 90° intervals with respect to said entry aperture center 50. Likewise, although not illustrated, the exit rollers 52 are substantially radially aligned with, and equidistant from, a center of said wire exit aperture, and are positioned at 90° intervals with respect to a center of the exit aperture.

FIG. 5 illustrates in detail the arrangement of the reel axle 24 and the rotatable reel unit 26 which is coupled to the reel axle 24 so as to be rotatable about the reel axle 24. The reel axle includes a first axle end 60 including a resistive surface receiving plate 62 welded to the reel axle 24 at weld point 63 and an opposite axle end 64 including a threaded surface 66. The rotatable reel unit 26 includes a cylindrical sleeve 68 welded to a resistive surface engaging plate 70 as indicated at weld spot 69. A rotation resistive surface 72 is provided between the resistive surface engaging plate 70 and the resistive surface receiving plate 62 by mounting a disk-shaped piece of material 74 about the reel axle 24. The disk-shaped piece of material 74 includes a central aperture and the rotation resistive surface 72. Preferably, the disk shaped piece of material 74 comprises a rubberized material having a relatively smooth surface 76 and an opposite, mechanically roughened, rotation resistive surface 72. For example, the disk shaped piece of material 74 is preferably formed from conveyor belting commonly used for incline conveyors, available from Belt Service, St. Louis, Mo., under the trade name "conveyor belting," and comprising a four ply cotton belt with a molded-on rubber or neoprene rough top design having a deep thread texture.

A reel unit mounting mechanism 78 is arranged to vary a degree of resistive contact between the rotatable reel unit 26 and the rotation resistive surface 72. The reel unit mounting mechanism 78 includes a first reel engaging member comprising a reel engaging pin 80 positioned at a first reel end of said rotatable reel unit 26, a second reel engaging member comprising a spool retaining collar 82 positioned at an opposite reel end of said rotatable reel unit 26, and a reel unit pressing member comprising a threaded nut 84 positioned at the opposite reel end.

A wire spool is mounted about the cylindrical sleeve 68 and engaged by the reel engaging pin 80 by removing the spool retaining collar 82 from the opposite axle end 64 and sliding the wire spool over the reel axle 24. The threaded nut 84 is rotated about threaded surface 66 so as to vary the contact force between the rotation resistive surface 72 and the resistive surface engaging plate 70 by urging the rotatable reel unit 26 and the resistive surface engaging plate 70 towards the rotation resistive surface 72. As the contact force increases, the wire spool unwinds less freely because the resistance between the rotation resistive surface 72 and the resistive surface engaging plate 70 necessitates an increased amount of torque when pulling wire off of the wire spool. Preferably, the contact force is increased with greater wire spool mass and decreased with decreasing wire spool mass. As a result, a technician unwinding wire from the spool will be able to conveniently control stoppage of the wire reel unwind and thus avoid inefficient and potentially dangerous unwinding of excess wire.

Having described the invention in detail and by reference to preferred embodiments thereof, it will be apparent that modifications and variations are possible without departing from the scope of the invention defined in the appended claims.

What is claimed is:

1. A wire reel unwind assembly comprising:

a rigid unwind assembly frame;

a rotatable unwind assembly post mounted to said unwind assembly frame and rotatable about a postal axis of rotation;

at least one wire reel mounting unit fixed to said assembly post, said wire reel mounting unit comprising a first L-shaped extension, a second L-shaped extension, a third L-shaped extension, and a fourth L-shaped extension, each L-shaped extension having a first leg fixed to said assembly post and a second leg spaced from said assembly post, a first wire reel mounting position defining a first wire reel axis, a second wire reel mounting position defining a second wire reel axis, a third wire reel mounting position defining a third wire reel axis, and a fourth wire reel mounting position defining a fourth wire reel axis, wherein said first wire reel axis is defined by a linear projection from a first reel axle mounting point on said second leg of said first L-shaped extension to a second reel axle mounting point on said second L-shaped extension, said second wire reel axis is defined by a linear projection from a first reel axle mounting point on said second leg of said second L-shaped extension to a second reel axle mounting point on said third L-shaped extension, said third wire reel axis is defined by a linear projection from a first reel axle mounting point on said second leg of said third L-shaped extension to a second reel axle mounting point on said fourth L-shaped extension, and wherein said fourth wire reel axis is defined by a linear projection from a first reel axle mounting point on said second leg of said fourth L-shaped extension to a second reel axle mounting point on said first L-shaped extension.

2. A reel wire unwind assembly as claimed in claim 1 wherein said rigid unwind assembly frame comprises a frame base and a frame extension, and wherein said rotatable unwind assembly post extends between said frame base and said frame extension along said postal axis of rotation.

3. A reel wire unwind assembly as claimed in claim 1 wherein said rigid unwind assembly frame comprises a wire guide track extending in a direction parallel to said postal axis of rotation, and a wire guide unit slidably mounted to said wire guide track.

4. A reel wire unwind assembly as claimed in claim 3 wherein said wire guide unit comprises:

a wire input face and a wire output face:

a first multidirectional rolling wire escort including a wire entry aperture positioned at said wire input face; and a second multidirectional rolling wire escort including a wire exit aperture positioned at said wire output face.

5. A reel wire unwind assembly as claimed in claim 4 wherein said first rolling wire escort comprises:

first, second, third, and fourth entry rollers including corresponding first, second, third, and fourth v-shaped entry guide grooves, wherein said rollers are substantially radially aligned with and equidistant from a center of said wire entry aperture, and wherein said rollers are positioned at 90° intervals with respect to said entry aperture center.

6. A reel wire unwind assembly as claimed in claim 5 wherein said second rolling wire escort comprises:

first, second, third, and fourth exit rollers including corresponding first, second, third, and fourth v-shaped exit guide grooves, wherein said rollers are substantially radially aligned with and equidistant from a center of said wire exit aperture, and wherein said rollers are positioned at 90° intervals with respect to said exit aperture center.

7. A reel wire unwind assembly as claimed in claim 1 wherein said rigid unwind assembly frame comprises at least one wire guide unit fixedly mounted to said rigid unwind assembly frame.

8. A reel wire unwind assembly as claimed in claim 1 wherein said at least one reel mounting unit comprises a plurality of reel mounting units fixed to said assembly post at spaced positions along a path parallel to said postal axis of rotation.

9. A reel wire unwind assembly as claimed in claim 8 wherein said rigid unwind assembly frame comprises a plurality of wire guide units fixedly mounted to said rigid unwind assembly frame at positions corresponding to said reel mounting unit spaced positions.

10. A reel wire unwind assembly as claimed in claim 9 wherein said rigid unwind assembly frame comprises a wire guide track, and a wire guide unit slidably mounted to said wire guide track to permit movement of said wire guide unit to a selected wire guide position corresponding to a position of one of said plurality of reel mounting units.

11. A reel wire unwind assembly as claimed in claim 9 wherein said at least one reel mounting unit comprises four L-shaped extensions and wherein each of said L-shaped extensions includes a first reel axle mounting point.

12. A reel wire unwind assembly as claimed in claim 11 wherein said at least one reel mounting unit further comprises four auxiliary extensions, and wherein said plurality of reel axes are defined by linear projections from each of said first reel axle mounting points to a corresponding second reel axle mounting point provided in each of said four auxiliary extensions.

13. A reel wire unwind assembly as claimed in claim 11 wherein said plurality of reel axes are defined by linear projections from each of said first reel axle mounting points to a second reel axle mounting point included in another L-shaped extension.

14. A reel wire unwind assembly as claimed in claim 1 wherein each of said plurality of reel axes lies in one of a reel unwind position and a rotated reel unwind position.

15. A reel wire unwind assembly as claimed in claim 14 wherein said reel unwind position and said rotated reel unwind position are co-planar.

16. A reel wire unwind assembly as claimed in claim 1 wherein at least one of said reel mounting positions comprise:

a reel axle;

a rotatable reel unit coupled to said reel axle so as to be rotatable about said reel axle;

a rotation resistive surface; and a reel unit mounting mechanism arranged to vary a degree of resistive contact between said rotatable reel unit and said rotation resistive surface.

17. A wire reel unwind assembly as claimed in claim 16 wherein said reel axle includes a first axle end including a resistive surface receiving plate and an opposite axle end including a threaded surface.

18. A wire reel unwind assembly as claimed in claim 16 wherein said rotatable reel unit comprises a cylindrical sleeve and a resistive surface engaging plate.

19. A wire reel unwind assembly as claimed in claim 16 wherein said rotation resistive surface comprises a first surface and a second roughened surface.

20. A wire reel unwind assembly as claimed in claim 16 wherein said reel unit mounting mechanism comprises a first reel engaging member positioned at a first reel end of said rotatable reel unit, a second reel engaging member positioned at an opposite reel end of said rotatable reel unit, and a reel unit pressing member positioned at said opposite reel end.

21. A wire reel unwind assembly as claimed in claim 20 wherein said first reel engaging member comprises a reel engaging pin, said second reel engaging member comprises a spool retaining collar, and said reel unit pressing member comprises a threaded nut.

22. A reel unwind assembly as claimed in claim 1 wherein said rotatable unwind assembly post comprises post rotation locking positions, and wherein said rigid unwind assembly frame includes a rotation locking unit arranged to selectively engage said post rotation locking positions.

23. A wire reel unwind assembly as claimed in claim 22 wherein said post rotation locking positions comprise holes, and wherein said rotation locking unit includes a hole engaging member coupled to a locking cable and a locking cable lever.

24. A wire reel unwind assembly comprising:

a rigid unwind assembly frame;

a rotatable unwind assembly post mounted to said unwind assembly frame and rotatable about a postal axis of rotation;

at least one wire reel mounting unit fixed to said assembly post, said wire reel mounting unit comprising a first L-shaped extension, a second L-shaped extension, a third L-shaped extension, and a fourth L-shaped extension, each L-shaped extension having a first leg fixed to said assembly post and a second leg spaced from said assembly post, a first auxiliary extension projecting from said first leg of said first L-shaped extension, a second auxiliary extension projecting from said first leg of said second L-shaped extension, a third auxiliary extension projecting from said first leg of said third L-shaped extension, a fourth auxiliary extension projecting from said first leg of said fourth L-shaped extension, a first wire reel mounting position defining a first wire reel axis, a second wire reel mounting position defining a second wire reel axis, a third wire reel mounting position defining a third wire reel axis, and a fourth wire reel mounting position defining a fourth wire reel axis, wherein said first wire reel axis is defined by a linear projection from a first reel axle mounting point on said second leg of said first L-shaped extension to a second reel axle mounting point on said first auxiliary extension, said second wire reel axis is defined by a linear projection from a first reel axle mounting point on said second leg of said second L-shaped extension to a second reel axle mounting point on said second auxiliary extension, said third wire reel axis is defined by a linear projection from a first reel axle mounting point on said second leg of said third L-shaped extension to a second reel axle mounting point on said third auxiliary extension, and wherein said fourth wire reel axis is defined by a linear projection from a first reel axle mounting point on said second leg of said fourth L-shaped extension to a second reel axle mounting point on said fourth auxiliary extension.

* * * * *

UNITED STATES PATENT AND TRADEMARK OFFICE
CERTIFICATE OF CORRECTION

PATENT NO : 5,732,899

DATED : March 31, 1998

INVENTOR(S) : William Edgar Wells

It is certified that error appears in the above-identified patent and that said Letters Patent is hereby corrected as shown below:

Col. 7, line 1, "reel wire" should be "wire reel".
Col. 7, line 6, "reel wire" should be "wire reel".
Col. 7, line 11, "reel wire" should be "wire reel".
Col. 7, line 19, "reel wire" should be "wire reel".
Col. 7, line 28, "reel wire" should be "wire reel".
Col. 7, line 37, "reel wire" should be "wire reel".
Col. 7, line 41, "reel wire" should be "wire reel".
Col. 7, line 46, "reel wire" should be "wire reel".
Col. 7, line 51, "reel wire" should be "wire reel".
Col. 7, line 57, "reel wire" should be "wire reel".
Col. 7, line 61, "reel wire" should be "wire reel".
Col. 8, line 1, "reel wire" should be "wire reel".
Col. 8, line 6, "reel wire" should be "wire reel".
Col. 8, line 9, "reel wire" should be "wire reel".
Col. 8, line 12, "reel wire" should be "wire reel".

Signed and Sealed this

Sixteenth Day of June, 1998

*Attest:*

Bruce Lehman

BRUCE LEHMAN

*Attesting Officer*

*Commissioner of Patents and Trademarks*